United States Patent [19]

Rambold

[11] Patent Number: 4,977,728

[45] Date of Patent: Dec. 18, 1990

[54] MACHINE FOR MAKING TEA-FILLED DOUBLE-CHAMBER BAGS

[75] Inventor: Adolf Rambold, Meerbusch, Fed. Rep. of Germany

[73] Assignee: Teepack Spezialmaschinen GmbH & Co. KG, Meerbusch, Fed. Rep. of Germany

[21] Appl. No.: 317,186

[22] Filed: Feb. 28, 1989

[30] Foreign Application Priority Data

Feb. 29, 1988 [DE] Fed. Rep. of Germany ..... 3806386

[51] Int. Cl.[5] ..... B65B 9/10

[52] U.S. Cl. ..... 53/567; 53/134; 53/413; 53/570; 493/356; 493/357

[58] Field of Search ..... 53/413, 134, 567, 570; 493/357, 426, 434, 454, 458, 214, 215, 224, 235, 244–247, 356, 359

[56] References Cited

FOREIGN PATENT DOCUMENTS 1001944 1/1957 Fed. Rep. of Germany .

2120270 4/1974 Fed. Rep. of Germany .

2405761 5/1975 Fed. Rep. of Germany .

*Primary Examiner*—Frederick R. Schmidt

*Assistant Examiner*—Jack Lavinder

*Attorney, Agent, or Firm*—Michael J. Striker

[57] ABSTRACT

A machine for manufacturing tea-filled double-chamber bags from a web of material continuously formed into a tube and on which tea is deposited in portion, the machine comprising cutting means for cutting off tube pieces containing two tea portions, a plurality of arms pivotably arranged on the transporting wheel of the machine for holding the tube pieces, a device for forming a bottom fold of a bag, and a stationary cover located in the area of the upper apex of the transporting wheel and extending in a rotational direction of the wheel at a peripheral surface thereof, the arms having bearing surfaces at their free ends for receiving the tube piece after cutting and pressing it against the underside surface of the cover.

10 Claims, 8 Drawing Sheets

11
12
13
12
18
14
21
28
30
36
37
24
23
30
15
22
29
20
48
40
28
21
51
22
50
28
60
62
64
61
63
28
31
29
43
10
31
32
A
B
C
D
E
F
G
H
J
45

14

12
11
16
13
12
17
18

50
53
52
22
23
55
42
21
56
57
58
51
43
45

MACHINE FOR MAKING TEA-FILLED DOUBLE-CHAMBER BAGS

BACKGROUND OF THE INVENTION

The invention relates to a machine for making tea-filled double-chamber bags from a web of material which is continuously formed into a tube. Equally spaced tea portions are deposited in the tube, and a tube piece containing two tea portions is cut off. The cut-off tube piece is received by a transporting wheel. The transporting wheel have arms rotatably mounted thereon and arranged in pairs at equal angular distances for seizing the cut-off tube piece. Each pair of arms supports a W-shaped profile cooperating with a hold-down device for forming a bottom fold. Finally, another device forms a head fold.

German Patent Specification No. 1,001,944 discloses a machine of the type mentioned in which the bags are formed and closed solely by folding. In the process, the transporting wheel with a cut-off tube piece passes progressively through various work stations in which the bag bottom and, after the two parts of the tube piece are raised, the head are closed. Progressive execution of individual working steps inevitably produces a certain irregularity in the production sequence. There is a risk, because of a bag tea being a free-flowing packaged commodity, that the portions of tea will not remain accurately placed during the production operation. Even slight slipping or spreading of portions of tea can considerably impair folding of the bags if, as a result, tea is deposited in the areas of the tube pieces which are provided for the bottom fold and/or the head fold. Vibrations and shocks have a particularly adverse effect after the tube piece is cut off from the tube web until the parts of the tube piece which are folded in a W-shape are closed.

Because of ever increasing demand, an increase in the production capacity is necessary. German Patent Specification Nos. 2,120,270, and 2,405,761 disclose a machine for making double-chamber bags in which individual production units are mounted on a continuously rotating transporting means. In the known machines, although the bag web is held in place in the area of the future bag bottom even before the individual sections are cut off, the sections containing the portions of tea remain largely insecure until directly before the head fold is formed. Therefore, a risk exists, in particular during raising of bag sections by arms, of the tea being spread. This hampers subsequent formation of the head fold. In addition, the continuous operation of the transporting means, as a rule, is performed with higher rotational speeds and, consequently, higher centrifugal forces. Therefore, a continuous operation further increases the risk of spreading.

SUMMARY OF THE INVENTION

The object of the present invention is a machine for making tea-filled double-chamber bags which enables use of higher working speeds and reduces a number of interferences, in particular, during formation of the bottom and hed folds.

The object of the invention is achieved by providing a fixed cover in the area of the upper apex of a continuously rotating transporting wheel which cover extends about a portion of the peripheral area of the transporting wheel, and by providing bearing surfaces at the free ends of the wheel arms. The bearing surfaces press the cut-off tube piece against the underside surface of the cover. The W-shaped profile is formed as an independent part whose outer legs are formed as flexible side parts. The outer legs hold the bottom fold in place after it is released by a holding-down device. The outer legs can be lowered into the interior of the transporting wheel in synchronism with closing movement of the arms.

The interaction between the fixed cover and the bearing surfaces of the arms ensures a reliable binding and an exact placing of the tube pieces directly after transfer to the transporting wheel during the entire further production process. Spreading of the tea is thus largely eliminated even under extreme conditions. In addition, the exact placing of the tube pieces ensures high dimensional accuracy when the W-shaped bottom fold is being formed and when the parts of the tube pieces are subsequently placed one against the other, during which procedure the bag bottom is pulled into the interior of the transporting wheel. This not only reduces centrifugal forces acting on the tea but also inertia forces acting on the transporting wheel. Reduction in inertia forces has a particularly advantageous effect on smooth running of the transporting wheel whereby undesirable vibrations in this critical production area are further reduced.

According to a preferred embodiment of the invention, in order to keep the bearing surface of the arms in constant contact with the underside surface of the cover to adequately secure the tube piece, at least one arm is mounted on a sliding block whose position inside a sliding guide can be varied by a rocking lever having one of its ends pivoted on the arm and its other end pivoted on the transporting wheel.

According to a further feature of the present invention, in order to ensure even better lateral fixing of the parts of the tube piece without damaging the tube material during completion of the bag, at least one longitudinally directed groove-like and spring-like connection is placed between the bearing surfaces of the arms and underside of the cover. A slight gap, however, is present between engagement flanks on both sides.

There is no substantial relative movement between the web and a cutter when the tube pieces are cut off from the tube web. The cutting device comprises a cutter shaft rotatable at the speed of the tube web and having at least one cutter edge, and a plurality of cutter bars which are arranged at equal angular distances on the transporting wheel.

According to another preferred feature of the invention, the cutter shaft, in the direction of movement of the tube web, is arranged in front of the upper apex of the transporting wheel. Its lower apex lies slightly below the upper apex of the transporting wheel so that the cut-off tube piece is in an entry plane which is as tangential as possible.

According to a further advantageous feature of the invention, the cutter edge of the cutter shaft has at least one notch so that the tube piece is not cut off completely from the tube web, and the final separation takes place only when the tube piece has been received and fixed by a bottom-folding station.

In order to fix the tube piece even better in the bottom-folding station and, at the same time, to be able to press the bottom fold into the profiled part to a sufficient depth without damaging the filter paper, the holding-down means preferably consists of two folding blades which are firmly connected to one another at a distance and between which there is mounted a spring-actuated folding plate whose lower end face has a notch intersecting with the apex of the profiled part.

Because of the continuous rotation of the transporting wheel and the higher rotational speeds which can be achieved thereby, it is convenient for forming the bag closure if, according to a preferred embodiment of the invention, a matrix having an approach edge for lobes, provides for forming the head fold of the parts of the tube piece and is arranged subsequent to the cover at the level of the peripheral plane of the transporting wheel. The matrix is orientated essentially parallel to the rotational axis of the transporting wheel and has a recess which tapers uniformly inwards and whose dimensions essentially correspond to those of the bag top. The recess interacts with a correspondingly shaped folding tongue of a slide which is arranged so as to be movable in a reciprocating manner essentially in the peripheral plane of the transporting wheel and which presses the lobe areas projecting beyond the recess surface on the outer surface of the matrix remote from the transporting wheel. At the same time, the folding tongue presses the lobes in the area of the recess to the inner surface of the matrix.

In this arrangement, the matrix, on the side opposite the approach edge, can advantageously have a folding edge which extends parallel to the approach edge and which, to turn over the bag top, interacts with a turn-over means.

In order to smooth the bag top after turning over and at the same time achieve a sharply formed fold, it can be convenient in a further embodiment of the invention to have the turn-over means interact with a tongue which pulls the top of the head fold around the approach edge of the turn-over means and presses it against the outer surface of the latter.

BRIEF DESCRIPTION OF THE DRAWINGS

The invention as to its construction so to its method of operation, together with additional objects and advantages thereof, will be best understood from the following description of the preferred embodiment with reference to the accompanying drawings wherein.

DESCRIPTION OF THE PREFERRED EMBODIMENTS

Figure 1:
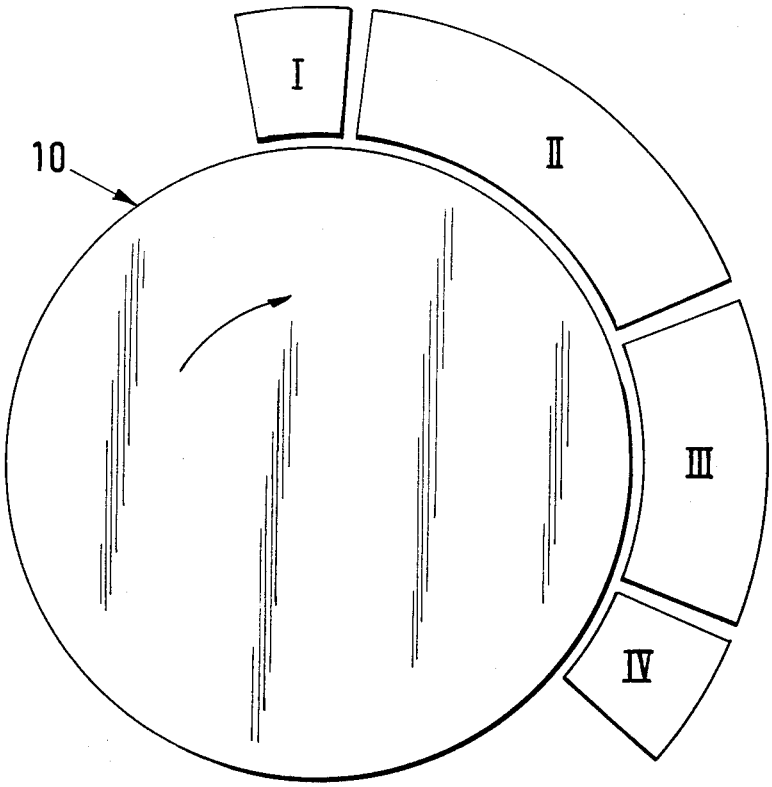
FIG. 1 shows a block-diagram of various work stations which a transporting wheel of a machine according to the invention passes through when rotating clockwise.

According to FIG. 1, during bag manufacture, transporting wheel 10 of the machine according to the invention continually passes through the following functional zones:

I. Cutting off tube pieces from a tube web,

II. Securing the tube pieces transferred to the transporting wheel,

III. Closing the tube pieces, folded in a W-shape, by head closure, and

IV. Pressing and raising the head fold as preparation for the subsequent stapling.

Figure 2:
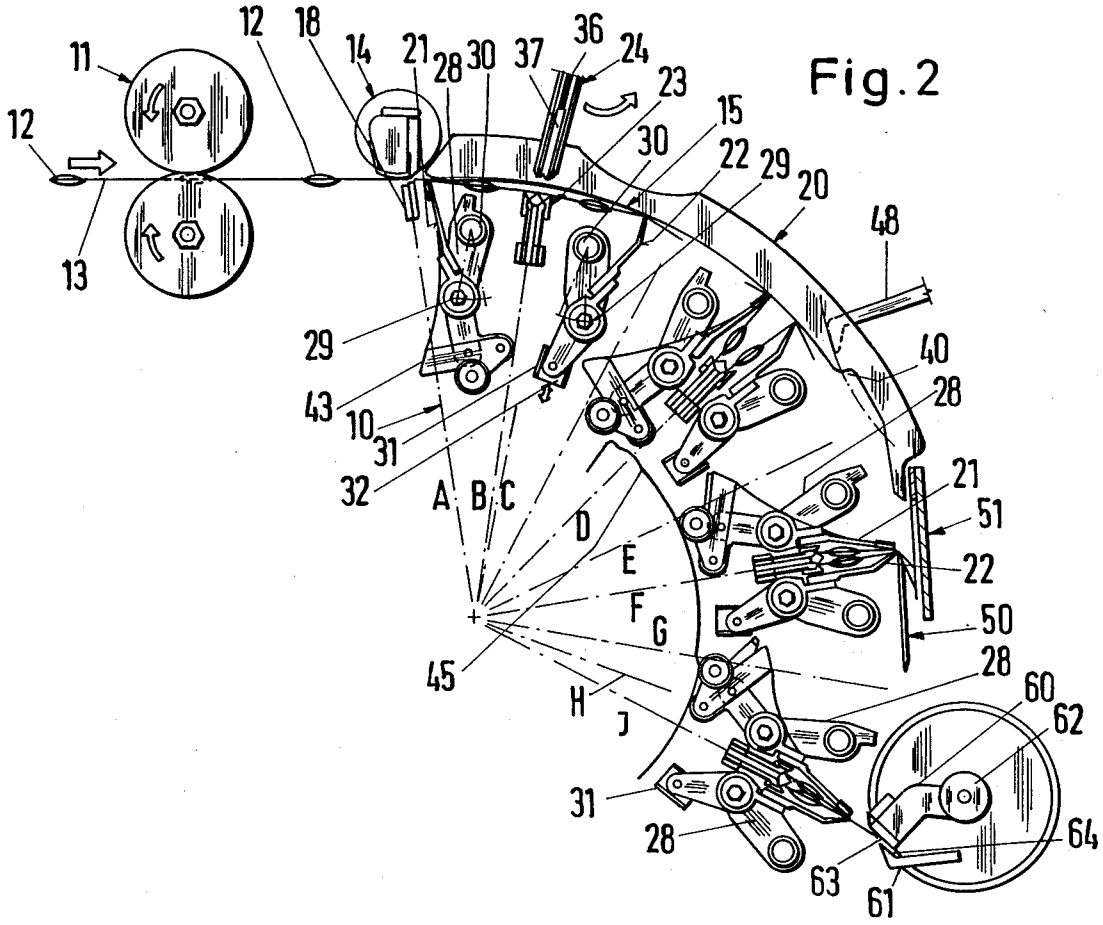
FIG. 2 shows schematically a partial front view of individual production units of the work stations according to FIG. 1 in a schematic working sequence.

As can be seen in particular from FIG. 2, the functional zone I mainly comprises a pair 11 of feed rollers which continuously feed to a cutting device 14 a tube 13 produced in a manner not shown from a web of material and filled with portions 12 of tea. The cutting device 14 cuts off from the web of material tube pieces 15 of the same size, each containing two portions 12 of tea. The functional zone II, which directly adjoins the cutting device 14, essentially consists of the transporting wheel 10, a fixed cover 20 above the transporting wheel 10, a plurality of arms 21, 22, arranged in pairs, for holding and securing the tube pieces 15, and a device for forming a bottom fold, which device has a plurality of profiled parts 23 and a holding-down means 24 interacting therewith. The following functional zone III forms a head-folding station in which the head closure is produced by means of a matrix 50 and a slide 51. Finally comes the functional zone IV, which, inter alia, is equipped with two press flaps 60 and 61 for pressing and raising the head fold. All units and other components of the machine which are located outside the functional zones mentioned are not a subject-matter of the invention and are, therefore, not described in greater detail.

Figure 3:
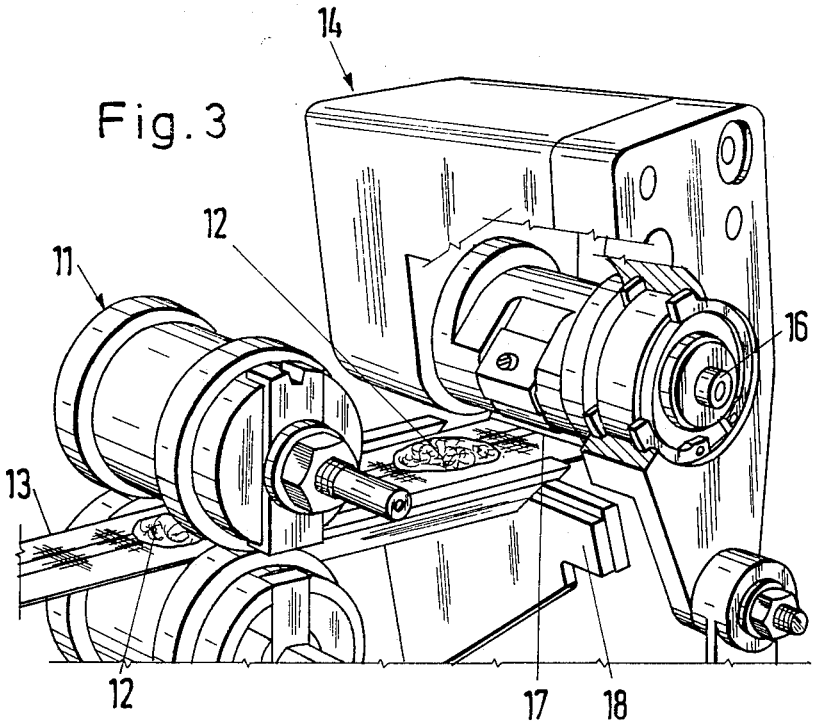
FIG. 3 shows schematically a perspective view of a cutting device, having a pair of feed rollers arranged upstream, according to FIG. 2.

The cutting device 14, shown on an enlarged scale in FIG. 3 includes the feed rollers 11 arranged upstream of a cutter shaft 16 with at least one cutter edge 17. The cutter edge 17 interacts with a cutter bar 18. The cutting device 14 is arranged at equal angular distances between two successive pairs 21, 22 of arms and is firmly connected to the transporting wheel 10. The cutter shaft 16 is driven continuously at the speed of a tube web and is arranged in the direction of movement of the tube 13 in front of the upper apex of the transporting wheel 10 at such a level that its lower apex lies slightly below the upper apex of the transporting wheel 10. The cutter edge 17 of the cutter shaft 16 has at least one, but preferably two spaced notches (not shown) whose mode of operation is described further below.

Figure 4:
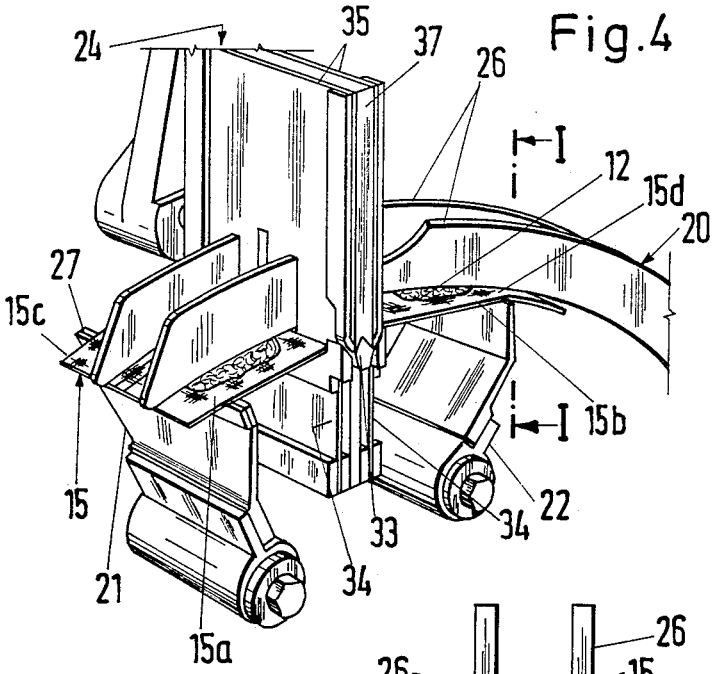
FIG. 4 shows schematically a perspective view of a portion of the machine in a working position according to position C in FIG. 2.

According to FIG. 4, a cover 20 extending up to the cutting device 14, is preferably, rail-shaped in the machine according to the present embodiment. It extends over the entire functional zone II, underside surfaces 25 of rails 26 lying at the level of the peripheral surface of the transporting wheel 10. The distance between the rails 26 conveniently corresponds to about one third of the width of the tube web. At the end face, the free ends of the arms 21, 22 have a bearing surface 27 for holding and securing the cut-off tube pieces 15. The arms 21, 22 are movably connected to one another and are controlled by an articulation system in such a way that the bearing surfaces 27 are constantly in contact with the underside surfaces 25 of the rails 26. The articulation system comprises a rocking level 28 (FIG. 2) which pivots with one of its ends 29 on the arms 21, 22 and with its other end 30 on the transporting wheel 10, a sliding guide 31 fixed to the transporting wheel 10, and a sliding block 32 on which the arms 21, 22 are rotatably mounted.

The profiled part 23 of the bottom-folding device is located centrally between each pair 21, 22 of arms and reciprocates inside the transporting wheel 10 essentially in a radial direction between an initial position (FIG. 2, position B) and an end position (FIG. 2, position F) and has flexible side parts 34 on both sides of a wedge-shaped center part 33. In the initial position, the upper edge of the profiled part 23 terminates at the tangential entry plane of the tube piece 15. The holding-down means 24 interacting with the profiled part 23 consists of two folding blades 35 which are firmly connected to one another at a distance and between which is mounted a folding plate 37 biased by a spring 36 (FIG. 2). The lower end face of the folding plate 37 is provided with a notch 38 which, in the working position of the bottom-folding device, interacts with the center part 33 of the profiled part 23. The holding-down means 24, which can be controlled from outside, performs an inswinging and outswinging movement and, in the lower area, has slots into which the rails 26 of the cover 20 engage when it assumes its working position. Parts 15*a*, 15*b* of the tube piece located on both sides of the profiled part 23 are seized in the end area outside the portions 12 of tea and pressed against the underside surface 25 of the cover 20 by the arms 21, 22 in such a way that two lobes 15*c* and 15*d* of unequal length are left free for subsequently forming the head fold in a manner known per se.

Figure 5:
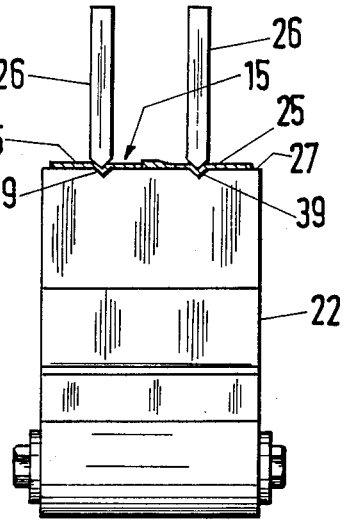
FIG. 5 shows a sectional view alone line I—I in FIG. 4.

In the present embodiment, the underside surfaces 25 of the rails 26 are wedge-shaped and engage into corresponding grooves 39 which are made in the bearing surfaces 27 of the arms 21, 22 (FIG. 5). However, to secure and bind the tube pieces, it can also be advantageous to design the underside surfaces of the rails 26 as straight surfaces, which engage into correspondingly shaped grooves in the bearing surfaces of the arms. To prevent damage of the tube material during engagement, it is always convenient to leave a slight gap between the engagement flanks of the groove and a spring connection.

Figure 6:
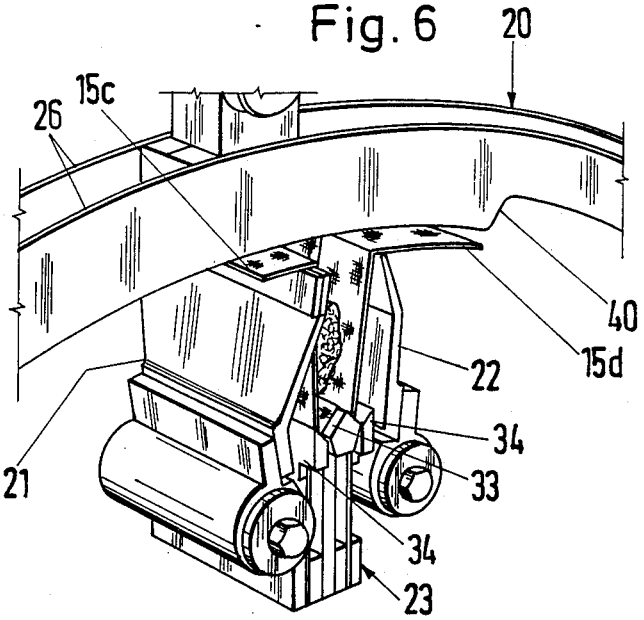
FIGS. 6–10 show schematically further perspective views of portions of the machine in working positions according to positions D, E, G and H in FIG. 2.

Towards the end of the functional zone II, the cover 20 has a stepped section 40 (FIGS. 2, 6 and 7) such that the underside surfaces 25 of the rails 26, relative to the plane of motion of the bearing surfaces 27 of the arms 21, 22, are set back slightly within a relatively small angular range in order to subsequently end in a straight surface 41 oriented essentially tangentially relative to the peripheral surface of the transporting wheel 10.

Figure 7:
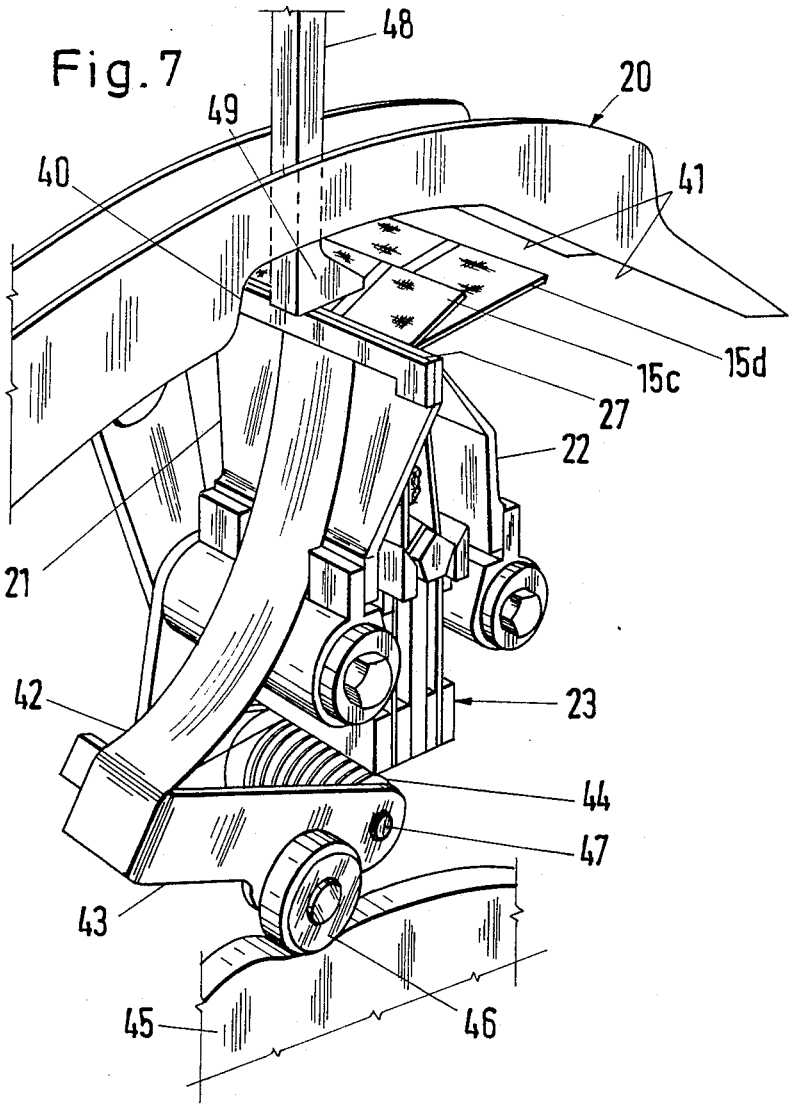

As can be seen in particular from FIG. 7, a tongue 42, preferably made of spring steel, is guided on the outer surface of the arm 21, which tongue 42, by means of a drag lever 43, can be displaced longitudinally against the force of a spring 44 from an initial position, in which the free end of the tongue 42 terminates at the upper edge of the arm 21 or the bearing surface 27, into a working position in which the free end of the tongue 42 protrudes beyond the bearing surface 27. The movement of the drag lever 43, connected to the arm 21 via a pivot spindle 47, is controlled via a cam plate 45 on which roller 46 fixed to the drag lever is displaceable. At the level of the stepped section 40, a lever 48 is arranged in a rotationally movable manner above the cover 20, the head 49 of which lever 48 passes through a curved path between the rails 26 in the area of the set-back underside surfaces 25 of the rails 26, at the apex point of which curved part the head 49 reaches as close as possible up to the path of motion of the arms 21, 22 but without touching their bearing surfaces 27.

Figures 8, 9:
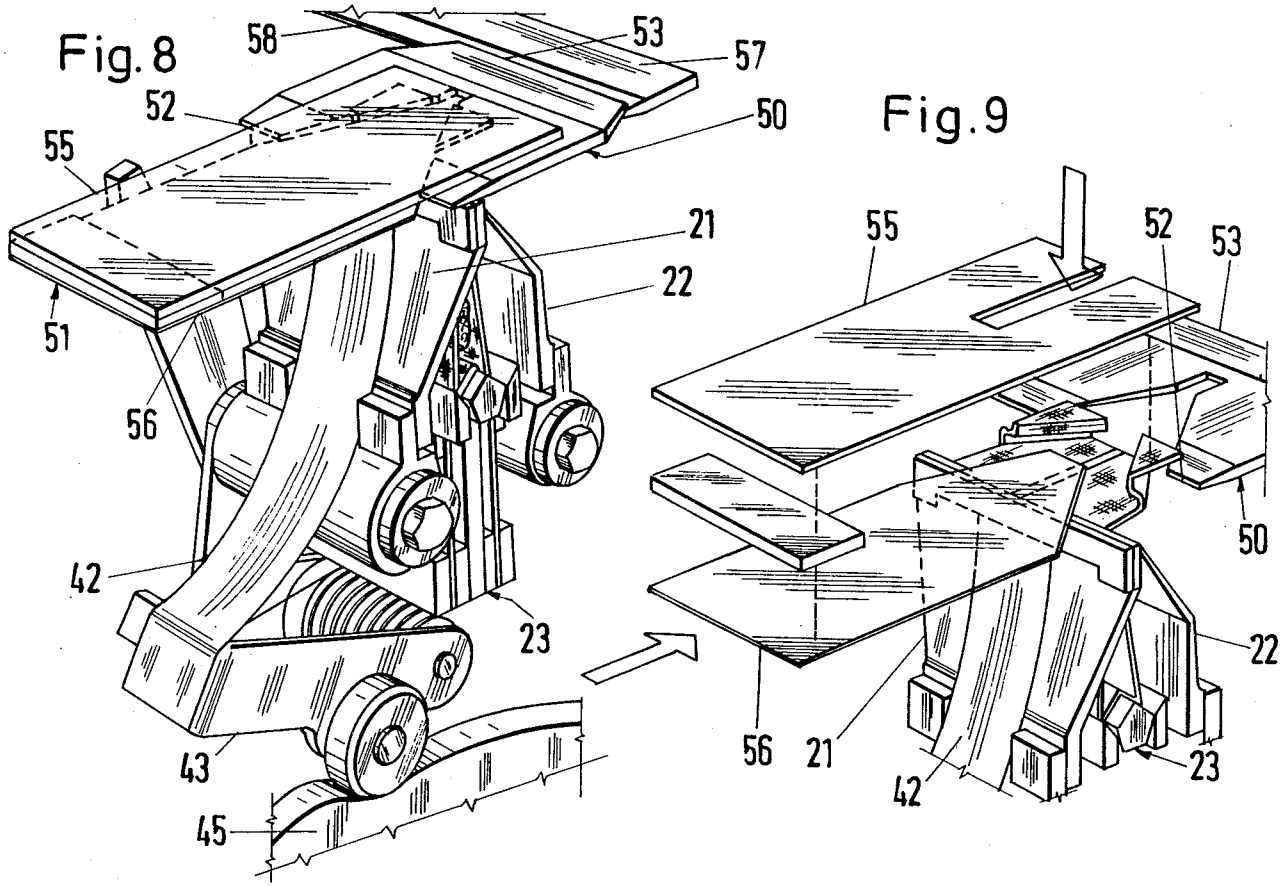

According to FIGS. 2, 8 and 9, the matrix 50, provided as an extension of the cover 20, and the slide 51 of the head-folding station, just like the trailing underside surfaces 25 of the rails 26, are orientated essentially tangentially relative to the peripheral surface of the transporting wheel 10. The matrix 50, which can move up and down essentially in the tangential plane, has an approach edge 52, directed upwards in a direction which is opposite to the direction of rotation of the transporting wheel 10 for acting on the lobes 15*c*, 15*d* provided for forming a head fold on the parts 15*a*, 15*b* of the tube piece 15. The matrix 50 has, on the opposite side, a folding edge 53 on which the bag top is turned over. Both edges 52, 53 are orientated essentially parallel to the rotational axis of the transporting wheel 10. The approach edge 52 is provided with a recess 54 having side surfaces which slope uniformly inwards and have a form and dimensions corresponding to the bag head after the side fold is formed. The slide 51, which is set back slightly outwards relative to the matrix 50, consists of a rigid cover plate 55 and a folding tongue 56 which is arranged parallel hereto, is made of spring steel, and its width corresponds to that of the tube piece 15. The end of the folding tongue 56 is designed so as to be trapezoidal in the rotational direction of the transporting wheel 10 in such a way that it can pass into the recess 54. For this purpose, the slide 51 moves in the rotational direction of the transporting wheel 10 in such a manner that initially it moves approximately tangentially from an initial position and then essentially parallel to the path of movement of the arms 21, 22 down into an end position. In the end position of the slide 51, the inner surface of the cover plate 55 is in contact with the outer surface of the matrix 50, and the outer surface of the folding tongue 56 is in contact with the inner surface of the matrix 50 (FIG. 8).

Figure 10:
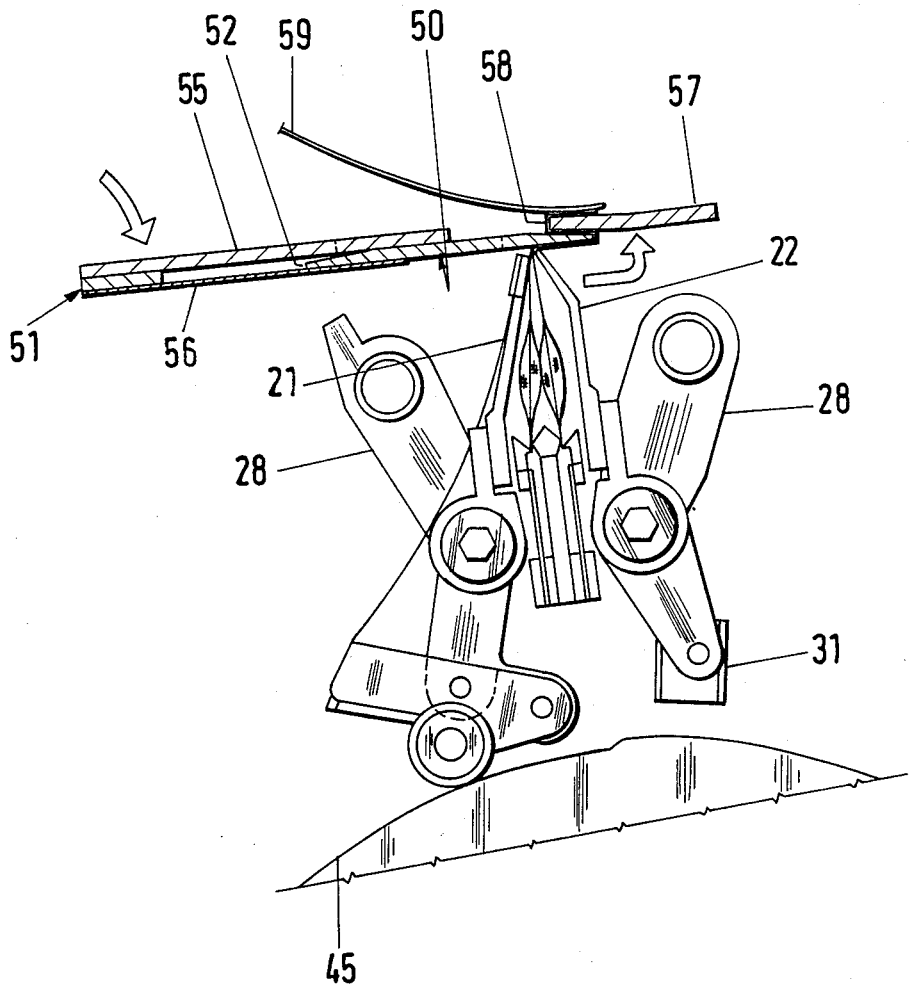

Arranged in the extended tangential plane of the matrix 50 is a turnover means 57 in the form of a flat steel bar which has a working edge 58 orientated parallel to the folding edge 53. The bar can move from an initial position on the inner surface of the tangential plane (FIG. 8) into an end position on the outer surface of the tangential plane in which its inner surface in the marginal area of the working edge 58 is in contact with the outer surface in the marginal area of the folding edge 53 of the matrix 50 (FIG. 10). In this end position, a flexible tongue 59 which is controlled in synchronism with the tangential movement of the matrix 50 bears against the outer surface in the marginal area of the working edge 58.

The press flaps 60, 61 provided subsequent to the functional zone III are an integral part of a work station in which the bag head, angled approximately tangentially in the rotational direction of the transporting wheel 10, is prepared for the following stapling. The press flap 60, which is rotatable anticlockwise by a shaft 62 outside the transporting wheel 10, has a working surface 63 which is orientated essentially tangentially and, on its circular path, is tangent to the path of movement of the arms 21, 22. The press flap 61 is pivotable on the press flap 60 and is controlled via a cam plate (not shown) in such a way that its working surface 64, in the area of the apex point of the two circular paths, comes into contact with the working surface 63 of the press flap 60.

The mode of operation of the individual units, shown in FIGS. 3 to 10, of the machine according to the invention are described below in the sequence of the working steps A to I according to FIG. 2.

The tube 13 fed continuously to the transporting wheel 10 maintains its largely horizontal entry plane until the tube web has reached the position shown at B in which the arms 21, 22 are swung in and hold in place and secure the tube piece 15 which has entered between cover 20 and transporting wheel 10. The tube piece fixed in such a way is then cut off from the tube web except for two small connecting bridges by the cutting device 14 in position A.

When position C is reached, the tube piece 15, being swung in by the holding-down means 24, is seized centrally between the two portions 12 of the tea and is pressed into the profiled part 23 to the extent that a W-shaped bottom fold results which is held in place by the flexible side parts 34 of the profiled part 23. To enable the bottom fold to be formed, the arms 21, 22 at the same time start their inwardly directed closing movement, which at this point results in the tube piece being torn off completely from the tube web. When the holding-down means 24 swings back into its initial position, the profiled part 23 moves radially downwards into the interior of the transporting wheel 10 and pulls the bottom fold down with it until the end position D is reached. In the process, the closing movement of the arms 21, 22, which starts at the same time, takes place in synchronism with the downward movement of the profiled part 23 until the arms 21, 22, shortly before reaching the stepped section 40 in the cover 20, have reached their final closing position in which the two raised parts **15*a*, 15*b* of the tube piece are pressed together above the portions 12** of the tea and thus continue to remain bound and secured until the head closure is complete.

Once the arms 21, 22 have passed the stepped section 40 in the cover 20 and the lobes **15*c*, 15*d* of the raised parts 15*a*, 15*b* of the tube piece have lost direct contact with the underside of the cover 20, the trailing shorter lobe 15*c* is raised by the tongue 42 moving up momentarily so that it is seized by the head 49 of the inswinging lever 48 and can be turned over in the rotational direction (position E or FIG. 7). The lobes 15*c*, 15*d*, are then pressed by the surface 41 of the trailing cover 20 outwards in the rotational direction to such an extent that, during their further passage, they run into the approach edge 52 of the matrix 50 of the head-folding station and are received there in the recess 54 (position F). At the same time, the slide 51 performs its folding movement, during which the folding tongue 56 crosses the path of movement of the matrix 50, and the cover plate 55 firmly clamps the lobe areas which have not been pressed through in order to obtain a sharp folded edge during folding of the sides (position G). During further passage along the inner side of the matrix 50, the top of the laterally folded lobes, after passing the folding edge 53 of the matrix 50, is folded over outwards by the folding movement of the turnover means 57 and is tightened by the tongue 59 (position H or FIG. 10**).

After leaving the head-folding station, the bag head, sharply angled relative to the radial plane, is raised again and at the same time is pressed by the two press flaps 60, 61 so that the closure staple can be reliably attached in a further operation (no longer shown).

It will be understood that each of the elements described above, or two or more together, may also find a useful application in other types of constructions differing from the types described above.

While the invention has been illustrated and described as embodied in a machine for making tea-filled double-chamber bags, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A machine for manufacturing tea-filled double-chamber bags from a continuous tubular web of material in which portions of tea have been deposited at equally spaced distances in the tubular web of material, said machine comprising cutting means for cutting off a tube piece from the tubular web of material containing two portions of tea; a transporting wheel continuously rotatable about an axis for receiving the cut-off tube piece, said transporting wheel having a peripheral surface and an upper apex; a plurality of arms pivotably mounted on said transporting wheel and arranged in pairs at equal angular distances for holding the tube piece; a device for forming a bottom fold in the tube piece, said device comprising a W-shaped profile associated with each pair of arms and located at the level of the peripheral surface of said transporting wheel, and holding-down means cooperating with said W-shaped profile to form the bottom fold; and a stationary cover located in an area of the upper apex of said transporting wheel and extending in a rotational direction of said transporting wheel essentially at the peripheral surface of said transporting wheel, said cover having an underside surface means; said arms having free ends and bearing surfaces located at end faces of said free ends, respectively for receiving the tube piece and for pressing it against said underside surface means of said cover, said W-shaped profile being an independent profiled part having outer legs, said outer legs comprising flexible side parts, respectively, for holding the bottom fold in place after it is released by said holding-down means, said outer legs being lowered in synchronism with a closing movement of said arms.

2. A machine according to claim 1 further comprising a sliding block for supporting at least one arm of a pair of arms, a slide guide for supporting said sliding block on said transporting wheel, and a lever for displacing said sliding block in said sliding guide.

3. A machine according to claim 1 wherein said bearing surfaces of said arms have groove means for receiving parts of said underside surface means of said cover.

4. A machine according to claim 1 wherein said cutting means includes a cutter shaft rotatable at a speed of movement of the tube and having at least one cutter edge, and a plurality of cutter bars arranged at equal angular distances on said transporting wheel.

5. A machine according to claim 4 wherein said cutter shaft is arranged in a direction of movement of the tube, in front of the upper apex of said transporting wheel, said cutter shaft having a lower apex lying below the upper apex of said transporting wheel.

6. A machine according to claim 4 wherein said cutter edge of said cutter shaft has at least one notch.

7. A machine according to claim 1 wherein said holding-down means includes two spaced folding blades firmly connected to each other, a folding plate located between said two blades, and spring means for biasing said folding plate towards said W-shaped profile, said W-shaped profile comprising a center part, and said folding plate having a low end face having a notch therein cooperating with said center part of said W-shaped profile.

8. A machine according to claim 1 further comprising a matrix located downstream of said cover at the level of the peripheral surface of said transporting wheel and having an approach edge for forming a head fold, said matrix being oriented substantially parallel to the rotational axis of said transporting wheel and having a recess which tapers uniformly inward and has dimensions corresponding to dimensions of the head portion of the tube piece; a slide movable tangentially relative to the peripheral surface of said transporting wheel and including a folding tongue cooperating with said recess to form a head fold.

9. A machine according to claim 8 further comprising turnover means, said matrix having at an end thereof which is opposite to said approach edge, a folding edge extending parallel to said approach edge and cooperating with said turnover means.

10. A machine according to claim 9 wherein said turnover means includes an edge having an outer surface, said machine further comprising a tongue for pulling the top of the head fold about said edge of said turnover means and for pressing the top of the head fold against said outer surface.

* * * * *